United States Patent [19]

Crowley et al.

[11] 4,255,818

[45] Mar. 17, 1981

[54] BACK OPENING SURGICAL GOWN

[75] Inventors: Donald J. Crowley, Sudbury, Mass.; Jimmy E. McLaughlin, El Paso, Tex.

[73] Assignee: American Hospital Supply Corporation, Evanston, Ill.

[21] Appl. No.: 64,228

[22] Filed: Aug. 6, 1979

[51] Int. Cl.[3] ..... A41B 13/10; A41B 9/00

[52] U.S. Cl. ..... 2/51; 2/114

[58] Field of Search ..... 2/51, 114, DIG. 7, 52

[56] References Cited

U.S. PATENT DOCUMENTS

| | | | |
|---|---|---|---|
| 3,359,569 | 12/1967 | Rotanz et al. | 2/114 |
| 3,594,818 | 7/1971 | Planner | 2/114 |
| 3,648,290 | 3/1972 | Hartigan | 2/114 |
| 3,721,999 | 3/1973 | Goya et al. | 2/114 |
| 3,754,284 | 8/1973 | Hartigan et al. | 2/114 |
| 3,803,640 | 4/1974 | Ericson | 2/114 |
| 3,864,575 | 2/1975 | Hartigan | 2/114 |
| 3,935,596 | 2/1976 | Allen, Jr. et al. | 2/114 |
| 3,977,025 | 8/1976 | Horan | 2/114 |
| 4,019,207 | 4/1977 | Newman et al. | 2/51 |

*Primary Examiner*—Doris L. Troutman

*Attorney, Agent, or Firm*—Larry N. Barger

[57] ABSTRACT

A back opening surgical gown with a belting system with improved gown attachment structure which reduces chance of damaging the sterile barrier provided by the gown and improves donning technique.

25 Claims, 3 Drawing Figures

BACK OPENING SURGICAL GOWN

BACKGROUND

U.S. Pat. 3,935,596 discloses a back opening surgical gown with a pair of belt sections secured to a transfer card at waist level of the gown. In the trade a back opening gown, often called a "sterile back" gown means one in which the entire gown is sterile, front and back. However, a surgeon does not touch the back of his gown because it is not good technique to place the hands where they cannot be seen. During donning a nurse can touch the gown back.

As a precautionary measure in surgical gowns, good technique requires that areas of the gown below the waist be considered not sterile and touching the gown below the waist should be avoided. However, for a belt to be functional, one end has to be attached to the gown at waist level.

Another U.S. Pat. No. 4,019,207 discloses a belting system which has a transfer card on only one belt section. The card is on a loose end of the belt section and could droop below the waist line.

Another important feature of surgical gowns is that a critical front area of the gown not be damaged in any way which might increase the chance of contamination transferring through the gown. A needle puncture through a front of the gown specifically to attach a belt section is highly undesirable. Adhesively attaching a belt section to a front of the gown is also undesirable because the tug on the belt section could tear fibers of the gown and possibly weaken it as a bacterial barrier in the critical front area of the gown. Disposable surgical gowns are usually made of nonwoven material and thus are likely to be damaged by an adhesive anchor being torn from the gown.

SUMMARY OF THE INVENTION

This invention overcomes the problems described above and provides an improved structure for anchoring all areas of the belting system at the front of the gown in special seamed areas without interferring with the bacterial barrier of such seams. This improved structure also can provide for holding the transfer card and tieable end of a tie strap well above waist level of the gown. The transfer card also has an improved structure which more tightly secures it to a wrapping belt section than to a card retainer on the gown.

THE DRAWINGS

DETAILED DESCRIPTION

Figure 1:
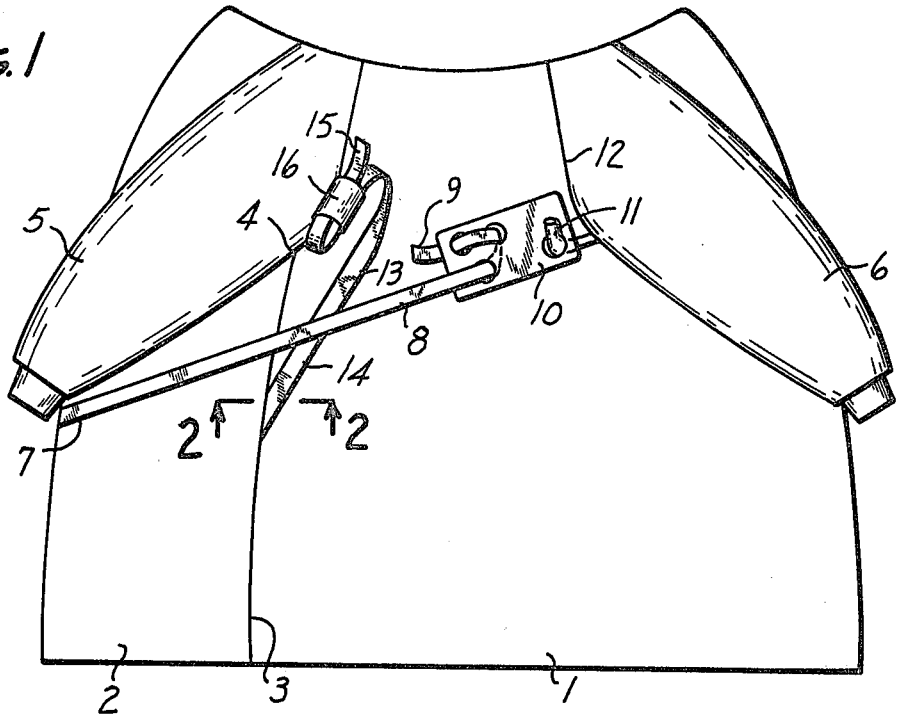
FIG. 1 is a front elevational view of the gown immediately prior to donning.

FIG. 1 shows a back opening surgical gown having a front section 1 secured to a wrap panel 2 along a seam 3. Seam 3 extends vertically to intersect a seam structure 4 which secures sleeve 5 to both the front section 1 and wrap panel 2 of the gown. A second sleeve 6 is also attached to the front section, but no seam silimar to seam 3 is used in the FIG. 1 version. However, if a similar seam is desirable, it could be used, particularly in larger sizes of gowns.

Attached adjacent an outer edge of wrap panel 2 is a first end 7 of wrap belt 8. A second end 9 of wrap belt 8 is secured to a transfer card 10 that is releaseably secured to a tab 11 anchored in seam 12 of sleeve 6.

A tie strap 13 has its first end 14 secured in seam 3. An opposite end portion 15 of tie strap 13 is releaseably held in a loop 16 secured in seam 4 of sleeve 5. It has been found that a better securement of a strap in loop 16 occurs when the tie is inserted into the top of a vertically extending loop.

Figure 2:
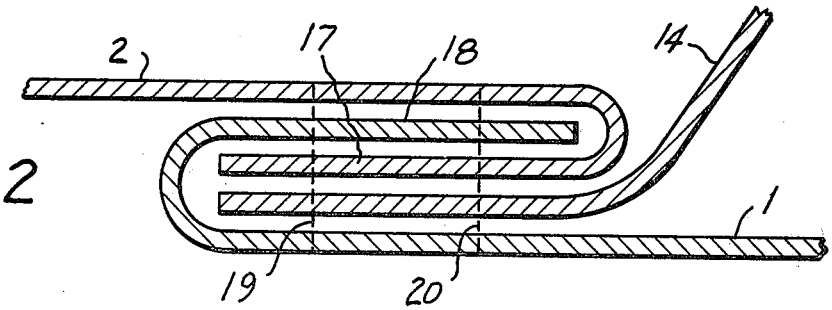
FIG. 2 is an enlarged sectional view taken along line 2—2 of FIG. 1.
Figure 3:
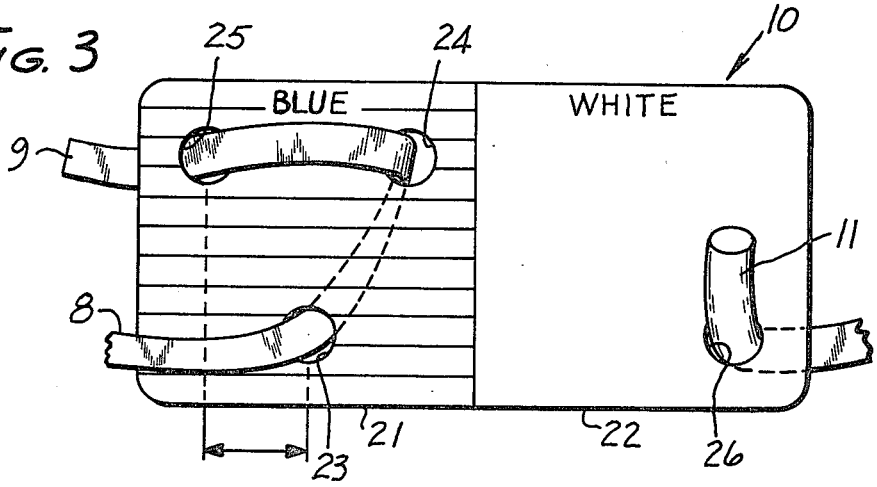
FIG. 3 is an enlarged sectional view of the improved transfer card.

In FIG. 2, the relationship between end 14 of tie strap 13 and seam 3 is shown. Here wrap panel 2 has a reverse locking fold section 17 that interfits with a reverse locking fold section 18 of front section 1. Double parallel stitchings 19 and 20 secure the front section, wrap panel 2, and tie strap 14 together. Because of the interfitting seam structure, there is little chance of the bacteria barrier at the seam being broken. Preferably, all seams on the gown are of this construction.

The transfer card 10 is divided into a first section 21 that is touched only by the surgeon and a section 22 that is only touched by the nurse doing the belting procedure. Preferably, these are of different colors, such as blue and white, to remind the surgeon and nurse to not touch same portions of the card. The donning nurse can be either a scrub nurse which is sterily gowned or a circulating nurse which is not.

Another feature of the transfer card is the greater holding power it has with respect to the wrap belt than it does with respect to tab 11. This is provided by a greater number of holes 23, 24, and 25 through which end 9 of wrap belt 8 is threaded. Holes 24 and 25 along one side of the card and the third hole 23 form a triangle. It has been found that a triangular arrangement of the holes with all angles less than 90° provides good retaining power for belt 8. Thus, hole 23 is spaced to the right of hole 25 and is longitudinally located between holes 24 and 25. If hole 23 is to the left of hole 25 this can cause the card to grip the belt too tightly. If hole 23 is to the right of hole 24, the belt is held too loosely in the card.

Tab 11 is frictionally retained in a single hole 26. Thus, should the physician grasp the card and move it outwardly away from the gown, tab 11 will always release prior to end 9 of the wrap belt. This greatly reduces the chance of wrap belt 8 prematurely separating from transfer card 10 and dropping to the floor which would require discarding of the gown and a regowning with a new gown.

The card works very well when made of a spun bonded polyolefin, such as Tyvek, marketed by DuPont. This material can be directly printed with the blue color and does not tear at the round holes which have material removed from the holes.

In the foregoing description, a specific example has been used to describe the invention. However, it is understood by those skilled in the art that certain modifications can be made to this example without departing from the spirit and scope of the invention.

We claim:

1. A back opening surgical gown of seamed construction which includes a front section and two sleeves wherein the improvement comprises: a wrap panel with outer and inner edges, the inner edge being joined to the front section at a side seam; a wrap belt having a first end secured to the gown adjacent the outer edge of the wrap panel and a second end removably held by a belt release means secured to a gown seam at a location spaced from a wrap belt's first end; a tie strap having a first end secured in the side seam and a second end removably held by a tie release means secured to a gown seam at a location spaced from the strap's first end.

2. A gown as set forth in claim 1, wherein both release means are secured to the gown above the first ends of the wrap belt and tie strap.

3. A gown as set forth in claim 1, wherein the sleeves are secured to the front section by seam, and the side seam connects with a first sleeve seam.

4. A gown as set forth in claim 3, wherein the tie release means is secured to the first sleeve seam.

5. A gown as set forth in claim 4, wherein the tie release means is a loop.

6. A gown as set forth in claim 3, wherein the belt release means is secured at a seam of a second sleeve.

7. A gown as set forth in claim 6, wherein the belt release means includes a tab protruding from the second sleeve seam and a transfer device releaseably secured to both the tab and the wrap belt.

8. A gown as set forth in claim 7, wherein the transfer device is a card with apertures to releaseably hold the wrap belt and tab to the card.

9. A gown as set forth in claim 8, wherein the card apertures hold the wrap belt more firmly than the tab.

10. A gown as set forth in claim 9, wherein the card has a greater number of apertures through which the wrap belt is threaded than through which the tab is threaded.

11. A gown as set forth in claim 10, wherein the card has three apertures for the wrap belt and a single aperture for the tab.

12. A gown as set forth in claim 6, wherein the transfer device has segregated indicia indicating one portion is to be touched only by the surgeon and another portion to be touched only by a gowning nurse.

13. A gown as set forth in claim 1, wherein the seams in the gown have interlocking reverse folds.

14. A gown as set forth in claim 13, wherein each seam has a plurality of parallel stitches.

15. A gown as set forth in claim 13, wherein the belt release means and tie release means have portions confined between the interlocking folds.

16. A back opening surgical gown of seamed construction having a pair of sleeves, wherein the improvement comprises: a wrap panel having an outer edge; and a wrap belt having a first end secured to the wrap panel adjacent its outer edge and a second end removably held by a belt release means secured to a gown seam adjacent the sleeve farthest removed from the belt's first end, and this belt release means is secured to such seam at a location above the belt's first end.

17. A gown as set forth in claim 16, wherein the belt release means is attached to a seam of such sleeve.

18. A back opening surgical gown of seamed construction which includes a front section and two sleeves, wherein the improvement comprises: a wrap panel with outer and inner edges, the inner edge being joined to a front section of the gown at a side seam that joins to and extends below a seam joining a sleeve to the gown; and a tie strap having a first end secured to the side seam and a second end removably held by a strap release means secured to a seam of this sleeve at a location above the tie strap's first end.

19. A surgical gown having a wrap belt with a transfer card removably attaching one end of the wrap belt to the gown, wherein the improvement comprises: structure on the transfer card to more firmly hold the card to the belt than to the gown.

20. A gown as set forth in claim 19, wherein the transfer card has apertures for receiving ends of the wrap belt and a protruding tab secured to the gown.

21. A gown as set forth in claim 20, wherein the card has a greater number of apertures for receiving the wrap belt than for receiving the tab.

22. A gown as set forth in claim 21, wherein the card has three apertures forming a triangle with no angle of the triangle being greater than 90°.

23. A gown as set forth in claim 22, wherein all angles of the triangle are less than 90°.

24. A gown as set forth in claim 19, wherein the card has a pair of longitudinally spaced apertures along one side of the card, and a third aperture spaced further from the card side than the said pair of apertures and the third aperture is also located along the card between the other two holes.

25. A surgical gown having a wrap belt with a transfer card removably attaching one end of the wrapped belt to the gown, wherein the improvement comprises: a spun bonded polyolefin transfer card with a plurality of apertures having removed material, which card has differently colored areas to indicate grasping portions for surgeon and nurse.

* * * * *